US011375821B1

(12) United States Patent
Purvis et al.

(10) Patent No.: US 11,375,821 B1
(45) Date of Patent: Jul. 5, 2022

(54) CONVERTIBLE MEDITATION CUSHION

(71) Applicants: Tangie Purvis, Youngsville, LA (US); Joseph Purvis, Youngsville, LA (US); Cameron Purvis, Youngsville, LA (US)

(72) Inventors: Tangie Purvis, Youngsville, LA (US); Joseph Purvis, Youngsville, LA (US); Cameron Purvis, Youngsville, LA (US)

( * ) Notice: Subject to any disclaimer, the term of this patent is extended or adjusted under 35 U.S.C. 154(b) by 0 days.

(21) Appl. No.: 17/352,268

(22) Filed: Jun. 19, 2021

(51) Int. Cl.
*A47C 13/00* (2006.01)
*A47C 3/16* (2006.01)
*A47C 15/00* (2006.01)

(52) U.S. Cl.
CPC ..... *A47C 13/005* (2013.01); *A47C 3/16* (2013.01); *A47C 15/004* (2013.01)

(58) Field of Classification Search
CPC ..... A47C 13/005; A47C 13/00; A47C 3/16; A47C 15/004; A47C 15/008
USPC ..... 297/452.48
See application file for complete search history.

(56) References Cited

U.S. PATENT DOCUMENTS

| | | | | |
|---|---|---|---|---|
| 717,703 | A | 1/1903 | McCarty | |
| 1,548,728 | A | 8/1925 | Milam | |
| 2,483,077 | A | 9/1949 | Walsh | |
| 2,528,768 | A | 11/1950 | Marsh | |
| 2,577,949 | A | 12/1951 | Barrett | |
| 2,623,574 | A | 12/1952 | Damsch | |
| 3,009,172 | A | 11/1961 | Eidam | |
| 3,259,925 | A | 7/1966 | Tilles | |
| 3,360,806 | A | 1/1968 | Dunaway | |
| 3,469,882 | A * | 9/1969 | Larsen | A47C 17/045 297/118 |
| 3,555,581 | A | 1/1971 | Friant | |
| 3,648,308 | A | 3/1972 | Greenawalt | |
| 3,659,297 | A | 5/1972 | Schutz | |
| 3,742,526 | A | 7/1973 | Lillard | |
| 3,890,658 | A * | 6/1975 | Petersilie | A47C 17/1655 5/2.1 |
| 3,902,759 | A | 9/1975 | Monteforte et al. | |
| 4,164,798 | A | 8/1979 | Weber | |
| 4,190,918 | A | 3/1980 | Harvell | |
| D258,482 | S | 3/1981 | Strock | |
| 4,457,032 | A | 7/1984 | Clarke | |
| 4,473,913 | A | 10/1984 | Ylvisaker | |
| 4,518,203 | A | 5/1985 | White | |
| 4,597,605 | A | 7/1986 | Gilbert | |
| 4,635,306 | A | 1/1987 | Willey | |
| 4,654,907 | A | 4/1987 | Haugaard | |
| 4,777,678 | A | 10/1988 | Moore | |
| 4,843,662 | A | 7/1989 | Handelman | |

(Continued)

FOREIGN PATENT DOCUMENTS

| | | | |
|---|---|---|---|
| GB | 2473819 | * | 3/2011 |

*Primary Examiner* — Mark R Wendell
(74) *Attorney, Agent, or Firm* — Greg Mier

(57) ABSTRACT

A convertible meditation cushion that facilitates multiple postural positions for meditation, including sitting, kneeling, and lying down. The preferred embodiment of the cushion has three semi-circular segments that are connected in series with hinges. The hinges allow the three semi-circular segments to be rotated with respect to one another to create a variety of configurations to facilitate the multiple postural positions for meditation.

19 Claims, 5 Drawing Sheets

(56) References Cited

U.S. PATENT DOCUMENTS

| | | | | |
|---|---|---|---|---|
| 5,029,350 | A * | 7/1991 | Edelson | A47C 3/16 297/229 |
| D319,365 | S | 8/1991 | Edelson | |
| 5,086,529 | A | 2/1992 | DeGroot | |
| 5,265,292 | A | 11/1993 | Underell | |
| 5,297,848 | A | 3/1994 | Grinnell | |
| 5,370,444 | A | 12/1994 | Stulik | |
| D366,383 | S | 1/1996 | Briegleb | |
| 5,491,851 | A | 2/1996 | Alonso | |
| 5,520,438 | A | 5/1996 | Stulik | |
| D377,574 | S | 1/1997 | Mades | |
| 6,230,352 | B1 * | 5/2001 | Kasem | A47G 9/0246 5/722 |
| 6,270,155 | B1 | 8/2001 | Rashid | |
| 6,371,641 | B1 | 4/2002 | Wilson, Jr. | |
| 6,691,356 | B1 | 2/2004 | Coma | |
| 6,711,766 | B2 | 3/2004 | Monk et al. | |
| D608,550 | S | 1/2010 | Sollberger et al. | |
| 8,287,437 | B1 * | 10/2012 | Rovere | A63B 69/004 482/88 |
| 8,578,526 | B1 | 11/2013 | Rosso | |
| 8,899,677 | B2 | 12/2014 | Hurlburt | |
| 8,939,505 | B1 | 1/2015 | Dreyer | |
| D762,399 | S | 8/2016 | Sorrick et al. | |
| 9,596,942 | B2 | 3/2017 | Kubota et al. | |
| D842,617 | S | 3/2019 | Carter | |
| 10,264,888 | B2 | 4/2019 | Clark | |
| 10,405,664 | B1 | 9/2019 | Wrazel | |
| D876,860 | S | 3/2020 | Swanson | |
| D880,193 | S | 4/2020 | Clark | |
| D901,201 | S | 11/2020 | McFarland | |
| D906,705 | S | 1/2021 | Jang | |
| 2008/0178391 | A1 | 7/2008 | Andrade | |

* cited by examiner

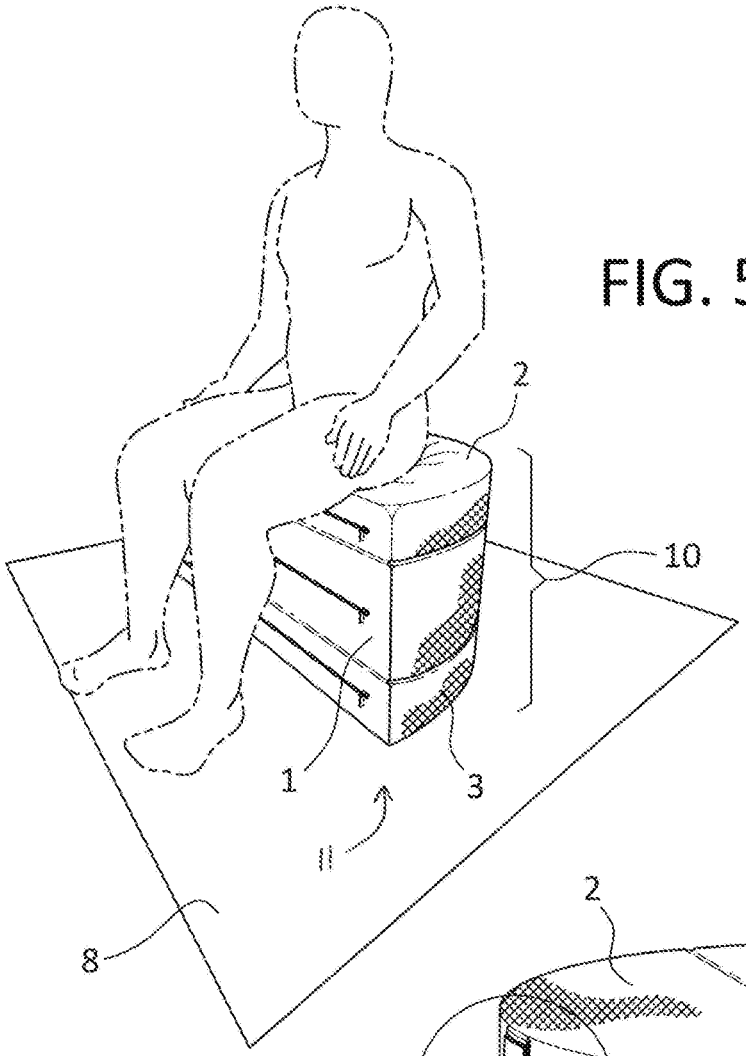
FIG. 5
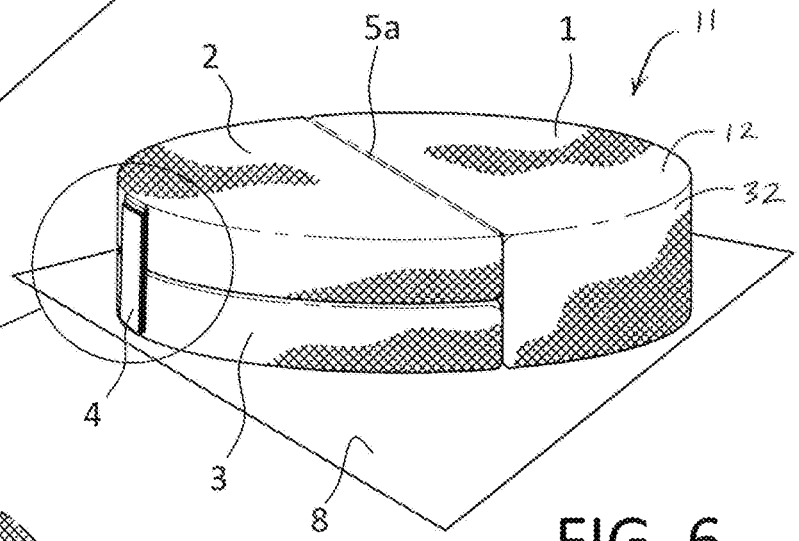
FIG. 7
FIG. 6
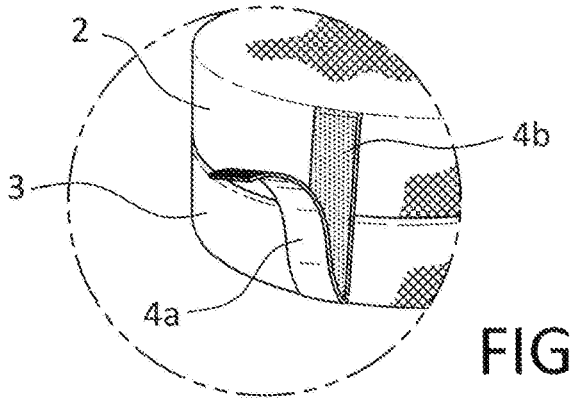
FIG. 7

CONVERTIBLE MEDITATION CUSHION

CROSS REFERENCE TO RELATED APPLICATIONS

The present application claims priority from provisional patent application No. 63/041,457, filed on Jun. 19, 2020.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC

Not applicable.

FIELD OF THE INVENTION

The subject invention relates generally to cushions. More particularly, the subject invention relates to a portable cushion with multiple sections that can be adjusted into multiple configurations.

BACKGROUND OF THE INVENTION

Meditation is a practice for individuals seeking ways to relieve stress and anxiety, to become more mindful, and to obtain physical benefits, such as, lower blood pressure and improved sleep. This practice is normally done in a sitting position with legs folded and crossed, but can also be performed while kneeling or lying down on the ground or floor. Common meditation postures include traditional full-lotus (sitting with legs crossed), Seize (kneeling), and Sharasana (lying down). The individual's flexibility largely determines how many positions the individual can perform to meditate comfortably. Oftentimes more than one position will be performed by different individuals during any meditation journey. An important aspect of meditation practice is proper alignment of the body and comfort during the meditation session. In most cases, some type of support is needed to maintain proper alignment and comfort during meditation.

For proper alignment during a sitting position, an individual's form and a comfortable foundation is crucial. The spine should be erect, with the lower back curved slightly inward and the upper back curved slightly outward. The neck is curved slightly inward with the head level. This posture facilitates postural equilibrium and naturally supports the body, which allows for maximum comfort and reduction of stress on the spine, all leading to an optimal meditation experience.

The human body is neither flat nor predictably curved. Without proper support, the human body will succumb to the shape of the surface on which it rests. This often causes misalignments in the legs, hips, spine, shoulders, neck, and head, creating great discomfort. Meditation cushions, pillows, yoga blankets, yoga bolsters, and any number of other props are used to adjust and improve posture and comfort level during meditation. Factors in choosing a meditation cushion include meditation posture, proper alignment, comfort, and aesthetic look and feel, as well as durability, size, weight, portability, and affordability.

Conventional meditation cushions typically have poly-fill or buckwheat hull fill, which tend to flatten over time and need to be refilled or discarded. In the specific case of buckwheat filling, living and dead insects sometimes occupy the filling. In addition, buckwheat filling is allergenic and is comparatively heavy. Thus, there is a need to provide a meditation cushion that improves upon the aforementioned conventional meditation cushions in quality and performance and adds unique features not found in the prior art.

SUMMARY OF THE INVENTION

The present invention is an improved meditation cushion that has a unique multi-positional, convertible design, with durable high-density foam core, lightweight construction, durable fabric, portability, and hypoallergenic materials. The present invention facilitates at least five postural positions for meditation.

BRIEF DESCRIPTION OF THE ATTACHED DRAWINGS

The accompanying drawings are provided for the purpose of illustration only and are not intended as a definition of the limits of the present invention. The drawings illustrate a preferred embodiment of the present invention.

FIG. 5 is a perspective view of an individual demonstrating another sitting position on the convertible meditation cushion of the present invention.

FIG. 6 is a perspective view of the convertible meditation cushion of the present invention in a fully closed configuration displayed on a substantially level support surface.

FIG. 7 is a perspective view the double hook-loop closure straps on the convertible meditation cushion of the present invention.

DESCRIPTION OF THE INVENTION

While the present invention will be described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

As shown in FIGS. 1 through 13, the present invention is a convertible meditation cushion 11 that facilitates multiple postural positions for meditation, including sitting, kneeling, and lying down. As shown in FIGS. 1, 2, 3, 4, 5, 6, 8, 9, and 12, the convertible meditation cushion 11 is designed to be positioned on a substantially level support surface 8, such as a floor, or the ground, or a mat, to support an individual during a meditation session.

Figure 12:
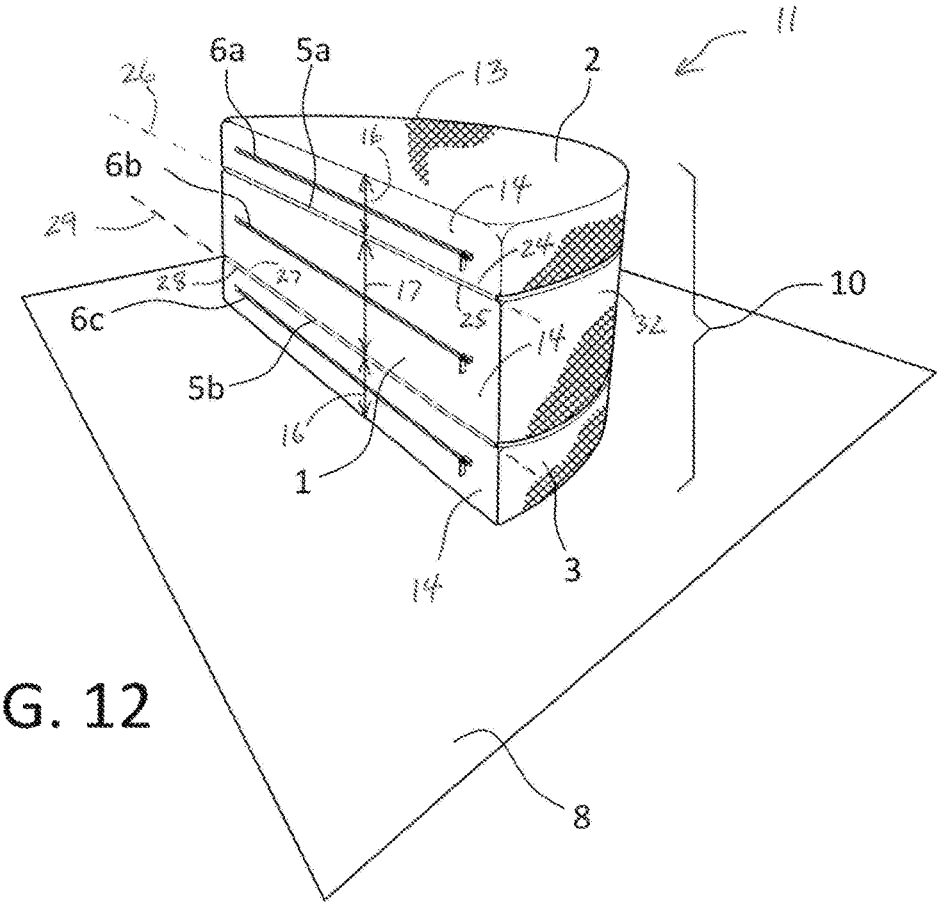
FIG. 12 is a perspective view of the convertible meditation cushion of the present invention displaying the underside of the fully closed configuration situated on a substantially level support surface, with three access zippers for removing the inner hypoallergenic, high-density foam core inserts.

As shown in FIGS. 1 through 13, the convertible meditation cushion 11 includes a first segment 1, a second segment 2, and a third segment 3. As best shown in FIGS. 9 and 12, when viewing the first segment 1, second segment 2, and third segment 3 from the top or bottom, the shape of each segment is that of a semi-circle, where the full arc 13 of the semi-circle for each segment measures substantially 180 degrees, and the straight side 14 of the semi-circle for each segment is preferably the same length, and the radius 15 of the semi-circle for each segment is preferably the same length.

The length of the straight side 14 of first segment 1, second segment 2, and third segment 3 is preferably in the range of 457.2 mm to 762 mm, and is preferably 609.6 mm. The radius of first segment 1, second segment 2, and third segment 3 is preferably in the range of 228.6 mm to 381 mm, and is preferably 304.8 mm.

Figure 1:
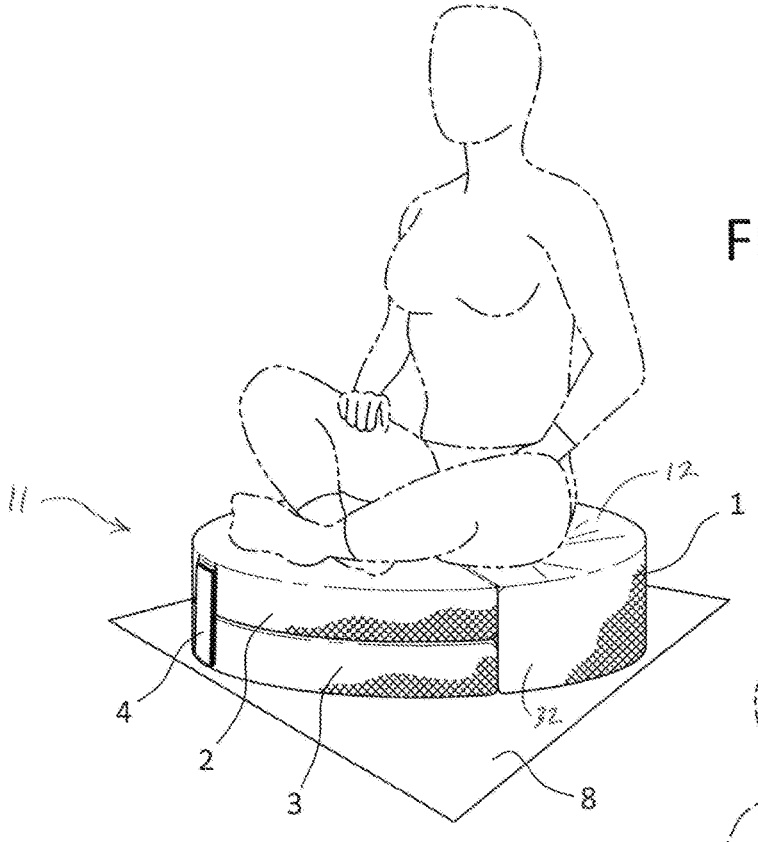
FIG. 1 is a perspective view of an individual demonstrating a sitting position on the convertible meditation cushion of the present invention.
Figure 2:
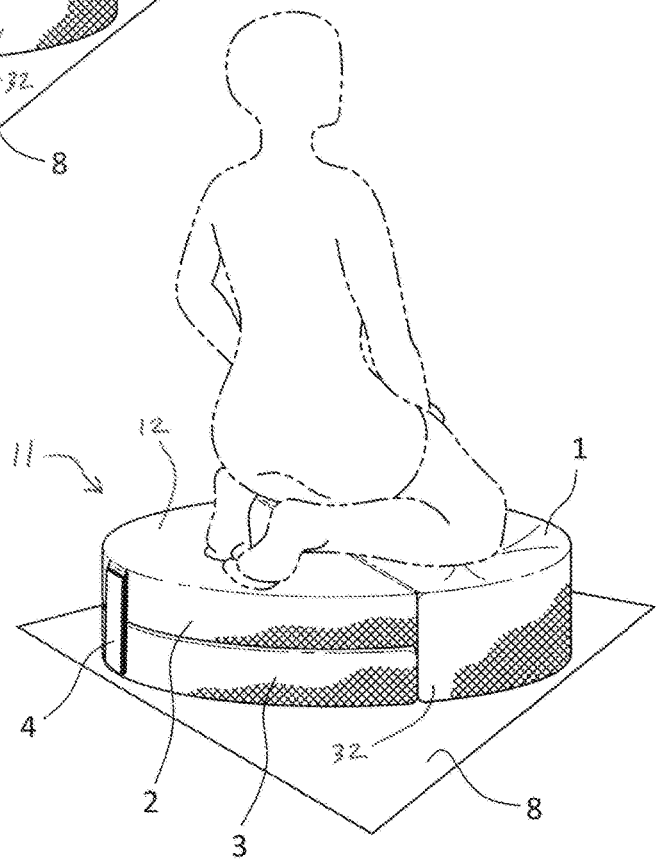
FIG. 2 is a perspective view of an individual demonstrating a kneeling position on the convertible meditation cushion of the present invention.

As shown in FIG. 1, the thickness 16 of second segment 2 and third segment 3 are preferably the same. The thickness 17 of first segment 1 is preferably twice the thickness 16 of each of second segment 2 and third segment 3. The respective thicknesses of first segment 1, second segment 2, and third segment 3 are critical because when second segment 2 and third segment 3 are stacked on one another and then positioned adjacent to first segment 1, as shown in FIGS. 1, 2, and 6, the top surface 12 provided by the stacked second segment 2 and third segment 3 and adjacent first segment 1 should be flat to facilitate multiple postural positions for meditation, as shown in FIGS. 1 and 2.

The thickness of first segment 1 is preferably in the range of 63.5 mm to 254 mm, and is preferably 127 mm. The thickness of second segment 2 and third segment 3 is preferably in the range of 31.75 mm to 127 mm, and is preferably 63.5 mm.

Figure 13:
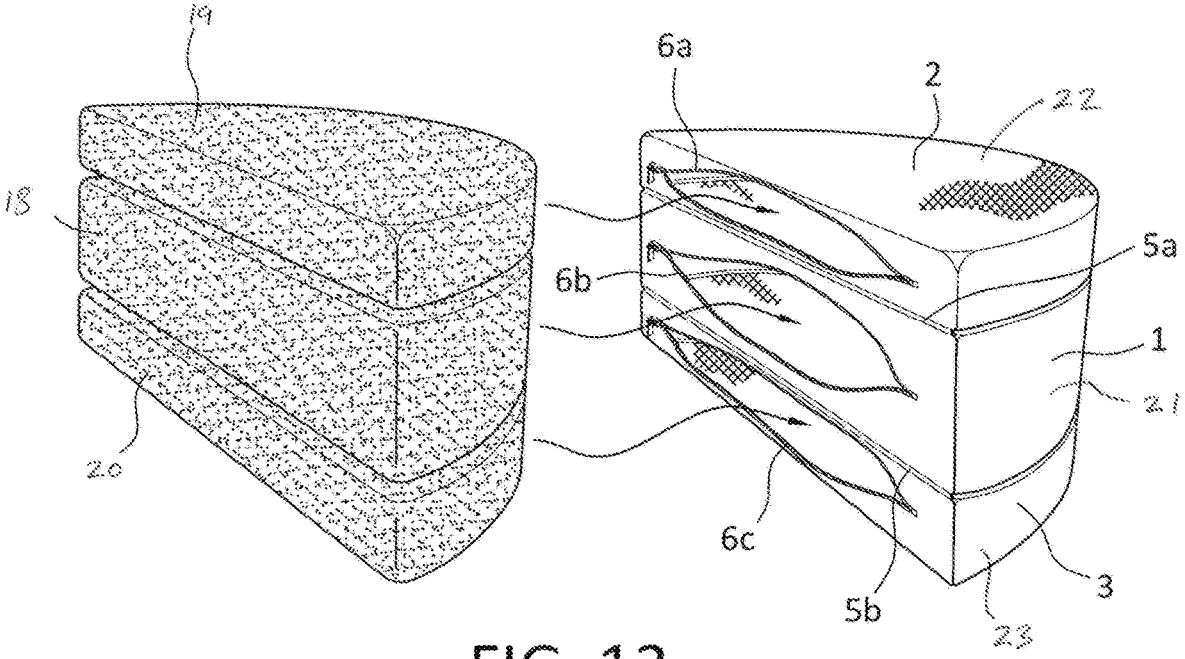
FIG. 13 is a perspective view of the cover for the convertible meditation cushion of the present invention and the hypoallergenic high-density foam core inserts for the convertible meditation cushion of the present invention.

The shape of first segment 1, second segment 2, and third segment 3 are a result of first insert 18, second insert 19, and third insert 20, respectively, as shown in FIG. 13. Each insert is preferably made from a high-density, inner hypoallergenic foam. First insert 18, second insert 19, and third insert 20 preferably fit snugly into separate fabric covers, namely, first fabric cover 21, second fabric cover 22, and third fabric cover 23, respectively, as shown in FIG. 13. The fabric covers 21, 22, and 23 are preferably made from a durable material, such as a porous cotton/polyester composition, which allows air circulation through the material. Each fabric cover 21, 22, and 23 is preferably equipped with a zipper 6*a*, 6*b*, 6*c*, respectively, for inserting and removing the inserts into and out of the fabric covers. The zippers 6*a*, 6*b*, and 6*c* are preferably located on the straight sides 14 of their respective fabric covers 21, 22, and 23, as shown in FIGS. 12 and 13. Each zipper preferably has a length in the range of 431.8 mm to 685.8 mm. The preferable length for each zipper is 558.8 mm.

Referring to FIG. 12, first segment 1 is preferably connected to second segment 2 with a first hinge 5*a*. Likewise, first segment 1 is preferably connected to third segment 3 with a second hinge Sb. First hinge Sa and second hinge 5*b* are preferably part of the material that makes up the first fabric cover 21, second fabric cover 22, and third fabric cover 23.

When the convertible meditation cushion 11 is in a stacked configuration, as shown in FIGS. 5 and 12 (designated by the number 10), first hinge 5*a* is preferably located along the bottom edge 24 of the straight side 14 of second segment 2 and the top edge 25 of the straight side 14 of first segment 1, thereby creating an axis of rotation 26, which allows second segment 2 to rotate substantially 180 degrees with respect to first segment 1. At one extreme of the 180-degree rotation, second segment 2 is stacked on top of or underneath first segment 1, as shown in FIGS. 3, 4, 5, 8, 9, and 12. At the other extreme of the 180-degree rotation, second segment 2 is aligned with half of first segment 1, as shown in FIGS. 1, 2, 6, and 10.

Likewise, when the convertible meditation cushion 11 is in a stacked configuration, as shown in FIGS. 5 and 12 (designated by the number 10), second hinge 5*b* is preferably located along the bottom edge 27 of the straight side 14 of first segment 1 and the top edge 28 of the straight side 14 of third segment 3, thereby creating an axis of rotation 29, which allows third segment 3 to rotate substantially 180 degrees with respect to first segment 1. At one extreme of the 180-degree rotation, third segment 3 is stacked on top of or underneath first segment 1, as shown in FIGS. 5 and 12. At the other extreme of the 180-degree rotation, third segment 3 is aligned with half of first segment 1, as shown in FIGS. 1, 2, 3, 4, 6, 8, and 10.

When both second segment 2 and third segment 3 are aligned with the respective halves of first segment 1, as shown in FIGS. 1, 2, and 6, the convertible meditation cushion 11 takes the shape of a disk. In this configuration, first segment 1 preferably provides support for heavier loads when an individual is using the convertible meditation cushion 11 for meditation. For example, when an 6 individual is sitting on the convertible meditation cushion 11, as shown in FIG. 1, the individual's buttocks should be positioned on top of first segment 1 and the individual's feet should be positioned on top of the stacked second segment 2 and third segment 3. As another example, when an individual is kneeling on the convertible meditation cushion 11, as shown in FIG. 2, the individual's knees should be positioned on top of first segment 1 and the individual's feet should be positioned on top of the stacked second segment 2 and third segment 3.

Figure 3:
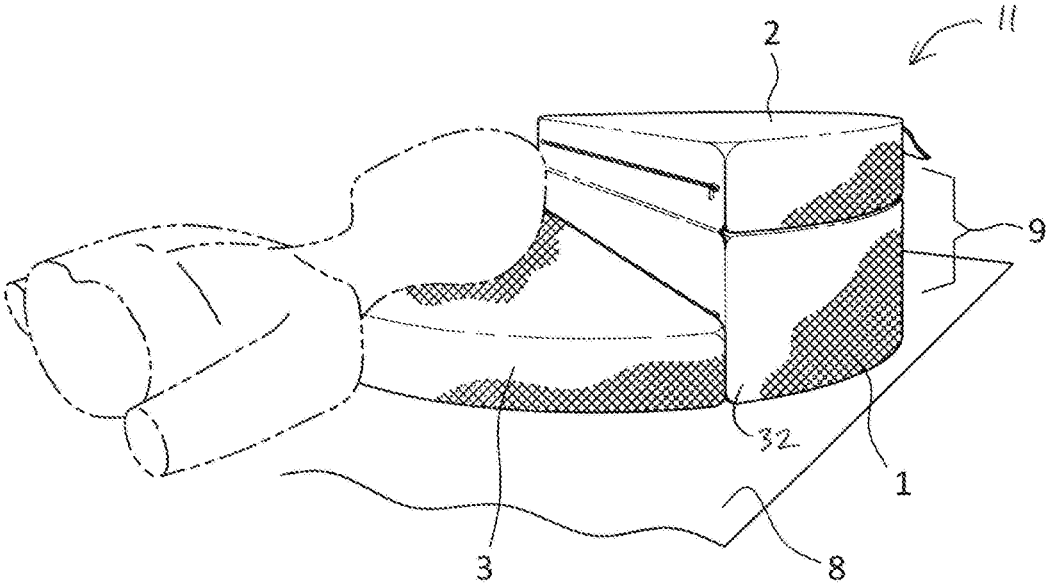
FIG. 3 is a perspective view of an individual demonstrating a supine position on the convertible meditation cushion of the present invention.
Figure 4:
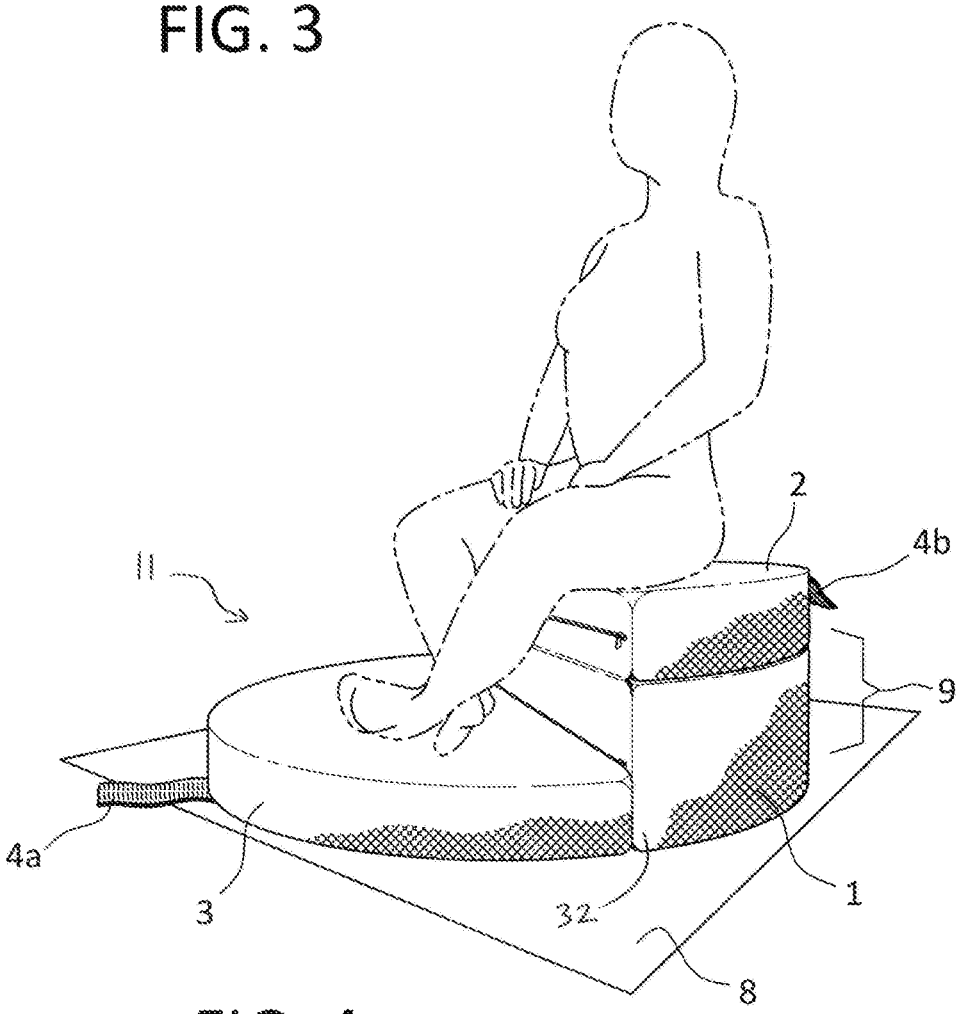
FIG. 4 is a perspective view of an individual demonstrating another sitting position on the convertible meditation cushion of the present invention.
Figure 8:
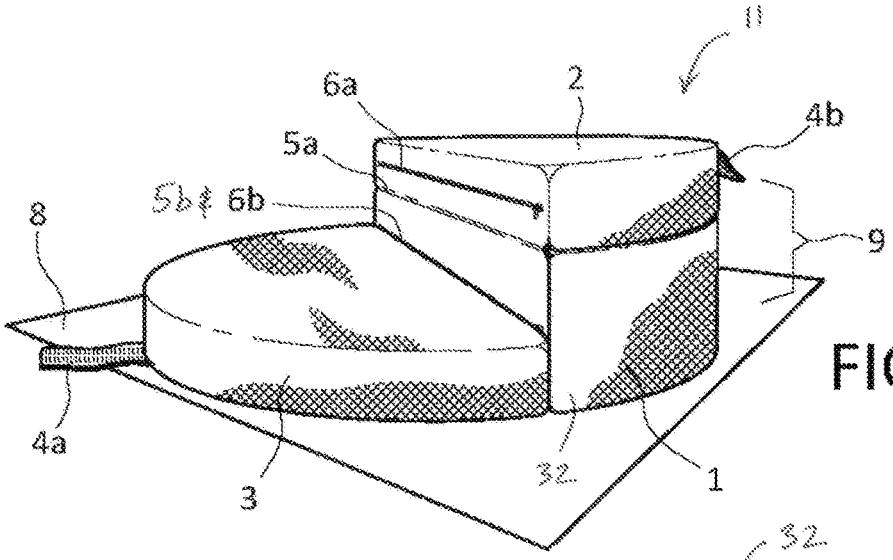
FIG. 8 is a perspective view of the convertible meditation cushion of the present invention in a partially open seat configuration displayed on a substantially level support surface.
Figure 9:
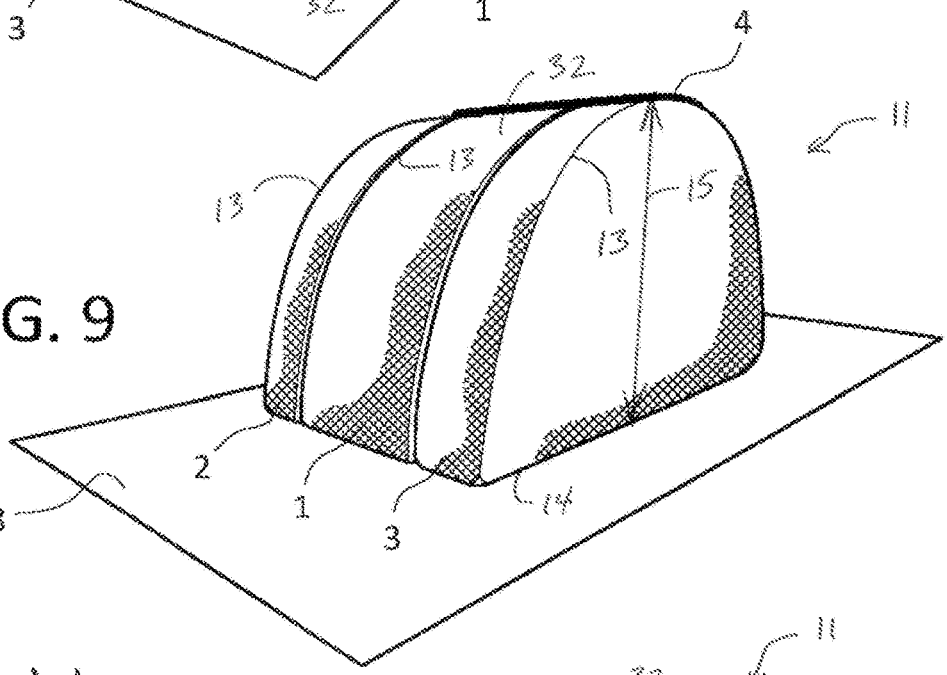
FIG. 9 is a perspective view of the convertible meditation cushion of the present invention in a fully closed, storage configuration placed on a substantially level support surface.

When only one of second segment 2 or third segment 3 is aligned with its respective half of first segment 1, and the other segment is stacked on top of first segment 1, as shown in FIGS. 3, 4, and 8 (designated by the number 9), the convertible meditation cushion 11 can be used by an individual in the supine position, as shown in FIG. 3, with the individual's head and neck supported by either the second segment 2 or third segment 3 that is aligned with its respective half of first segment 1. In addition, when the convertible meditation cushion 11 is in this position, it can be used by an individual in the sitting position, as shown in FIG. 4, with the individual's buttocks supported by either the second segment 2 or third segment 3 that is stacked on top of the first segment 1, and with the individual's feet placed on either the second segment 2 or third segment 3 that is aligned with its respective half of first segment 1.

When second segment 2 and third segment 3 are stacked above and below first segment 1, as shown in FIGS. 5 and 12 (designated by the number 10), the convertible meditation cushion 11 can be used by an individual in the sitting position, as shown in FIG. 5, with the individual's buttocks supported by either the second segment 2 or third segment 3 that is stacked on top of the first segment 1, and with the individual's feet placed on support surface 8.

As shown in FIGS. 1, 2, 4, 6, 7, 8, and 11, the convertible meditation cushion 11 is preferably equipped with a strap 4 to secure the convertible meditation cushion 11 in a closed configuration, as shown in FIGS. 1, 2, 6, and 10. Strap 4 has two lineal strips—4*a* and 4*b*, as shown in FIGS. 4, 7, 8, and 11, that preferably work together as a hook-and-loop fastener (commonly referred to as Velcro). When the convertible meditation cushion 11 is in a closed configuration, as shown in FIGS. 1, 2, 6, and 10, lineal strips 4*a* and 4*b* can be aligned and secured together to keep second segment 2 and third segment 3 adjacent to one another, as shown in FIGS. 1, 2, 6, and 10. When the convertible meditation cushion 11 is in a fully opened configuration, as shown in FIGS. 5, 9, and 12, lineal strips 4*a* and 4*b* can be aligned and secured together to keep second segment 2 and third segment 3 stacked with first segment 1, as shown in FIGS. 5, 9, and 12. Strap 4 and its two lineal strips 4*a* and 4*b* allow the convertible meditation cushion 11 to be used, carried, and/or stored in the closed or fully opened configuration.

The length of lineal strips 4*a* and 4*b* is preferably in the range of 63.5 mm to 254 mm, and is preferably 127 mm. The width of lineal strips 4*a* and 4*b* is preferably in the range of 19.05 mm and 76.2 mm, and is preferably 31.75 mm.

Figure 10:
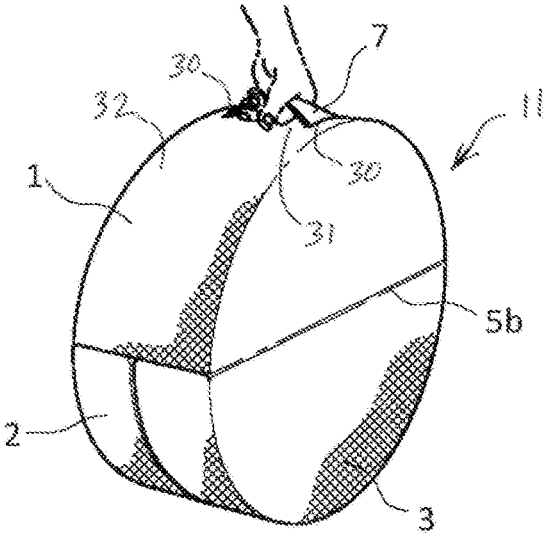
FIG. 10 is a perspective view of the convertible meditation cushion of the present invention in a fully closed, portable configuration, featuring a carry handle.
Figure 11:
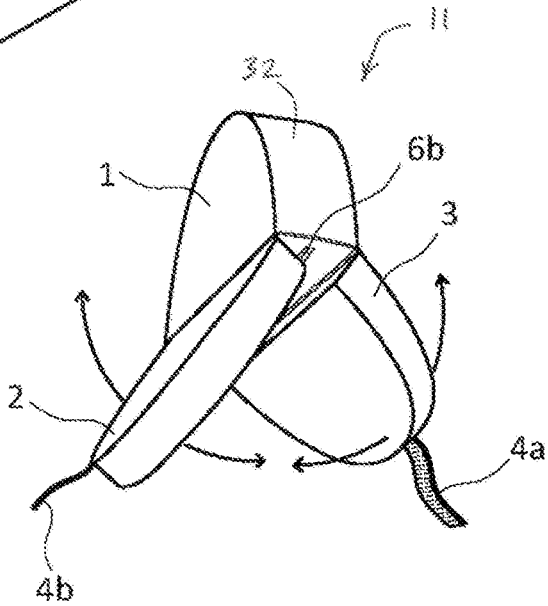
FIG. 11 is a perspective view of the convertible meditation cushion of the present invention demonstrating the operation of the convertible meditation cushion's hinging action.

As shown in FIG. 10, the convertible meditation cushion 11 is preferably equipped with a handle 7, which is preferably a lineal strip having two ends 30 that are both attached to first segment 1 at or near the midway point 31 of its circular side 32. When the convertible meditation cushion 11 is in a closed configuration, as shown in FIGS. 1, 2, 6, and 10, handle 7 can be used to conveniently carry the convertible meditation cushion 11, as shown in FIG. 10. Handle 7 can also be used to carry the convertible meditation cushion 11 when the convertible meditation cushion 11 is in the open position, as shown in FIG. 9. Handle 7 remains accessible even when the lineal strips 4*a* and 4*b* of strap 4 are overlapped when the convertible meditation cushion 11 is in the closed position. In addition, the convertible meditation cushion 11 can be carried using strap 4 when the convertible meditation cushion 11 is in a closed configuration, as shown in FIG. 6.

The length of handle 7 is preferably in the range of 63.5 mm to 254 mm, and is preferably 127 mm. The width of handle 7 is preferably in the range of 25.4 mm to 76.2 mm, and is preferably 38.1 mm.

It should be appreciated that the convertible meditation cushion 11 may be made in a variety of sizes and dimensions to accommodate a variety of individuals of different sizes and shapes. It should also be appreciated that the convertible meditation cushion 11 may come in a variety of shapes in addition to the preferred semi-circular shape to accommodate different aesthetic niches and varieties. In addition, it should also be appreciated that the convertible meditation cushion 11 may be used in conjunction with yoga, exercise, stretching, and other general forms of sitting.

It should be understood that one embodiment of the present invention has been disclosed by way of example and that other modifications and alterations may occur to those skilled in the art without departing from the scope and spirit of the present invention.

What is claimed is:

1. A cushion comprising (a) a first segment having at least one flat side with a top and a bottom, said first segment having a second side with a top and a bottom, said first segment having a top edge extending along said top of said flat side of said first segment and a bottom edge extending along said bottom of said flat side of said first segment;

(b) a second segment having at least one flat side with a top and a bottom, said second segment having a second side with a top and a bottom, said second segment having a top edge extending along said top of said flat side of said second segment and a bottom edge extending along said bottom of said flat side of said second segment, where said bottom edge of a straight side of said second segment is rotatably connected to said top edge of a straight side of said first segment with a first hinge, where said first hinge creates a first axis of rotation around which said second segment rotates substantially 180 degrees with respect to said first segment;

(c) a third segment having at least one flat side with a top and a bottom, said third segment having a second side with a top and a bottom, said third segment having a top edge extending along said top of said flat side of said third segment and a bottom edge extending along said bottom of said flat side of said third segment, where said top edge of a straight side of said third segment is rotatably connected to said bottom edge of said straight side of said first segment with a second hinge, where said second hinge creates a second axis of rotation around which said third segment rotates substantially 180 degrees with respect to said first segment;

(d) a strap comprising a first lineal strip and a second lineal strip, where said first lineal strip of said strap has a first end and a second end, and where said second lineal strip of said strap has a first end and a second end, where said first end of said first lineal strip of said strap is attached to said top of said second side of said second segment opposite said flat side of said second segment, and where said first end of said second lineal strip of said strap is attached to said bottom of said second side of said third segment opposite said flat side of said third segment, where said first lineal strip of said strap and said second lineal strip of said strap can be aligned and secured together to keep said second segment and said third segment adjacent to one another when said second segment and said third segment are rotated adjacent to one another, and where said first lineal strip of said strap and said second lineal strip of said strap can be aligned and secured together to keep said second segment and said first segment adjacent to one another and said third segment and said first segment adjacent to one another when said second segment and said third segment are rotated adjacent to said first segment; and (e) a handle attached to said second side of said first segment opposite said flat side of said first segment.

2. The cushion of claim 1, where said first segment, said second segment, and said third segment are three-dimensional semi-circles having said flat side, an arc measuring 180 degrees opposite said flat side, and a thickness.

3. The cushion of claim 2, where said flat sides of each of said first segment, said second segment, and said third segment have lengths that are substantially the same.

4. The cushion of claim 3, where said length of each of said flat sides of said first segment, said second segment, and said third segment is in the range of 457.2 mm to 762 mm.

5. The cushion of claim 4, where said length of each of said flat sides of said first segment, said second segment, and said third segment is 609.6 mm.

6. The cushion of claim 5, where said arcs of each of said first segment, said second segment, and said third segment have a radius tat are substantially the same length.

7. The cushion of claim 6, where said length of said radius of each of said arcs of said first segment, said second segment, and said third segment is in the range of 228.6 mm to 381 mm.

8. The cushion of claim 7, where said length of said radius of each of said arcs of said first segment, said second segment, and said third segment is 304.8 mm.

9. The cushion of claim 8, where said thickness of said second segment and said thickness of said third segment have a length that are substantially the same.

10. The cushion of claim 9, where said length of said thickness of said second segment and said third segment is in the range of 31.75 mm to 127 mm.

11. The cushion of claim 10, where said length of said thickness of said second segment and said third segment is 63.5 mm.

12. The cushion of claim 11, where said thickness of said first segment has a length that is twice said length of said second segment and said third segment.

13. The cushion of claim 12, where said length of said thickness of said first segment is in the range of 63.5 mm to 254 mm.

14. The cushion of claim 13, where said length of said thickness of said first segment is 127 mm.

15. The cushion of claim 14, where each of said first segment, said second segment, and said third segment further comprise an insert made from a high-density, inner hypoallergenic foam, where each insert is enclosed in a fabric cover made from a durable, porous, cotton/polyester material.

16. The cushion of claim 15, further comprising a zipper on said fabric cover for each of said first segment, said second segment, and said third segment, for inserting and removing said insert from said fabric cover.

17. The cushion of claim 16, where said zipper on each of said first segment, said second segment, and said third segment is located on said flat side of each of said first segment, said second segment, and said third segment.

18. The cushion of claim 17, where said first lineal strip of said strap and said second lineal strip of said strap each have a length in the range of 63.5 mm to 254 mm, and where said first lineal strip of said strap and said second lineal strip of said strap each have a width in the range of 19.05 mm and 76.2 mm.

19. The cushion of claim 18, where said handle has a length in the range of 63.5 mm to 254 mm, and said handle has a width in the in the range of 25.4 mm to 76.2 mm.

* * * * *